United States Patent [19]

Mesenhoeller

[11] Patent Number: 4,794,829

[45] Date of Patent: Jan. 3, 1989

[54] RATCHET-TYPE WRENCH

[76] Inventor: Hans Mesenhoeller, Hastener Str. 94, 5630 Remscheid, Fed. Rep. of Germany

[21] Appl. No.: 474,046

[22] Filed: Mar. 10, 1983

[51] Int. Cl.[4] ..... B25G 1/00

[52] U.S. Cl. ..... 81/177.8

[58] Field of Search ..... 81/177.5 T, 177.8, 177.9, 81/175, 163

[56] References Cited

U.S. PATENT DOCUMENTS

| | | | |
|---|---|---|---|
| 841,692 | 1/1907 | Kanning | 81/177.8 |
| 855,014 | 5/1907 | McGlone | 81/177.8 UX |
| 1,039,831 | 10/1912 | Sisson | 81/177.8 |
| 1,248,025 | 11/1917 | Simon | 81/163 |
| 1,313,575 | 8/1919 | Bernardi | 81/175 X |
| 1,360,051 | 11/1920 | Strang . | |
| 2,848,917 | 8/1958 | Cook | 81/163 |
| 2,865,240 | 12/1958 | Kniser . | |

FOREIGN PATENT DOCUMENTS

| | | | |
|---|---|---|---|
| 237431 | 3/1910 | Fed. Rep. of Germany . | |
| 27238 | 4/1981 | Fed. Rep. of Germany | 81/177.9 |
| 3006651 | 8/1981 | Fed. Rep. of Germany T | 81/177.5 |
| 179919 | 11/1886 | France | 81/177.8 |

*Primary Examiner*—James G. Smith

*Attorney, Agent, or Firm*—Antonelli, Terry & Wands

[57] ABSTRACT

A ratchet-type wrench including a working head, a lever arm that can be angularly positioned, and a locking mechanism disposed between the lever arm and the working head for securing the working head in the angled position. An axially arranged spindle in the lever arm operates the locking mechanism, with a handle being adapted to rotate the spindle and also pivot the lever arm to enable the wrench and locking mechanism to be operated by one hand. The locking mechanism includes an axially non-rotatably displaceable catch member provided at the lever arm, with the catch member being adapted to be brought into shape mating engagement with the working head.

3 Claims, 3 Drawing Sheets

Figure 1:
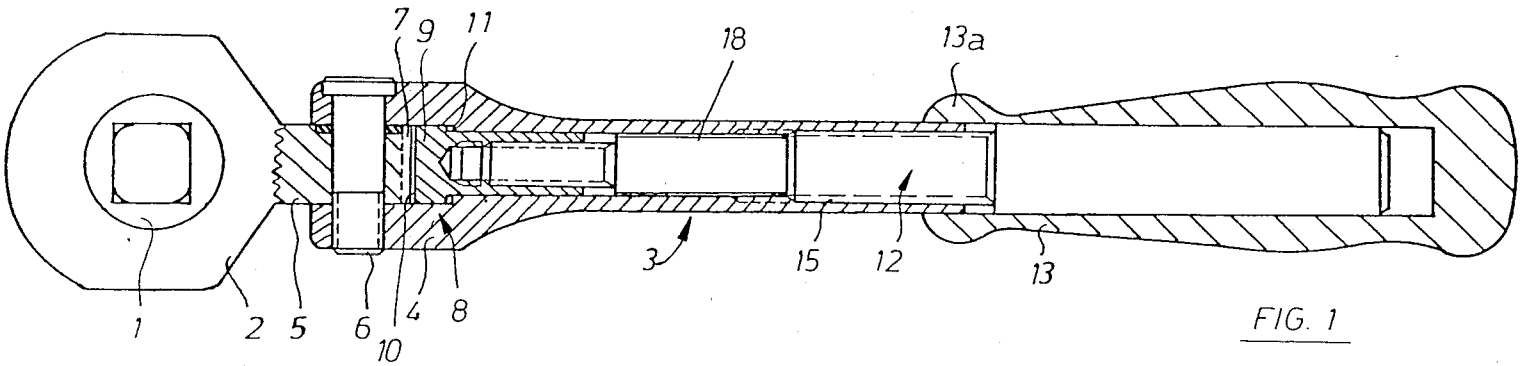

M
19
12
14
15
16
3
17
8
10
11
9
7
4
6
5
2
1
X
X
20
12
12
M
B
19
19

RATCHET-TYPE WRENCH

The invention relates to a ratchet-type wrench including a working head, a lever arm that can be angled, and a locking mechanism securing an angled position between the lever arm and the working head, with the locking mechanism being operable by a threaded spindle axially arranged in the lever arm and traveling in a threaded portion on the lever arm side.

A ratchet or ratchet-type wrench, of the aforementioned type, is proposed in from German Patent No. 237,431. Wherein, the working head is provided with a ball on the rear side thereof, with the ball being supported in a spherical articulated fork of the lever arm. By means of a spindle axially penetrating the tubular lever arm, the rearward ball can be tightly pressed against the inner surface of the articulated fork, thus locking the angled position of the lever arm. A nut resting on the free end of the lever arm serves for adjusting the spindle; with the nut being rotated by a separate wrench. This conventional wrench is cumbersome in handling, offers only limited safety against unintended release, due to the merely force-locking arresting action, and, moreover, is relatively expensive in its manufacture.

The invention is based on the object of providing the wrench of the above-discussed type with an inexpensive, single-handedly operable locking mechanism for the selected angling of the grip, wherein the danger of unintended release is securely forestalled.

In order to attain this object, the invention provides that the spindle carries, at its rear end, a handle suitable for rotating the spindle as well as for swiveling the lever arm. Due to this feature, the wrench, after having been placed on a polygonal part to be rotated, such as, for example, a spark plug, can be locked in the desired angled position with one and the same hand by turning the handle, and the spark plug or the like can be loosened from its firm seating by pulling at the handle whereupon, using the very same hand, the locking action can be released and finally the wrench can be operated with a steep position in the manner of a screw driver. In the arrangement, according to this invention, the thread on the lever arm side is advantageously a left-handed thread so that locking takes place by turning the handle toward the left, while the locking action is released by turning toward the right.

According to a preferred embodiment of the invention, the provision can be made that the locking mechanism comprises an axially displaceable catch member which is, however, supported at the lever arm so that it cannot be rotated, with the catch member being adapted to be placed in shape-mating engagement with the working head. By such a shape-mating engagement, great safety is ensured against unintended unlocking.

In a further development of the invention, the spindle engages at the front end thereof with the catch member by means of a thread running counter to the thread on the lever arm side. Since, in such opposite threads, the axial movements are added up, a relatively deep shape-mating engagement can be produced with a relatively slight turning of the spindle.

According to additional features of the invention, the provision can be made that the tubular lever arm is fashioned at the front as an articulated fork receiving, between two planar surfaces, the rearward, flat portion of the working head; and that the working head carries serrations on its back lying in the articulated fork, and the catch member has, on its front side, one or two wedge-shaped ridges adapted to the serrations. This results in a very convenient manipulability if, according to a preferred embodiment, the height of the serrations is approximately equal to or less than the axial displacement path of the catch member at a 180° revolution of the spindle.

Furthermore, the provision can also be made in accordance with this invention that the handle has a bead-like end section extending over the end of the lever arm.

The wrench according to the invention, after having been placed on the polygonal part to be rotated, for example, a spark plug, can be locked by using one and the same hand into the desired angled position by means of turning the handle, and by pulling at the handle, the spark plug or the like can be loosened from its firm seating, whereupon the locking mechanism is released with the same hand, and finally the wrench can be operated with a steep position in the manner of a screw driver. The handle is thus to be manipulated dually; for this reason, it is suitable to secure the locked position of the working head when using the handle as a pivoting lever.

The provision is made for this purpose that the center lines of the cross-sectional area of the handle have differing lengths. In this connection, the cross-sectional area of the handle can be a rectangle, rounded or beveled at the corners, or it can also be an oval. According to the invention, the provision is made that the longer cross-sectional center line of the handle lies, when the working head is locked, within the swivel plane and, in the unlocked position, at, for example, a right angle, with respect to the swivel plane of the wrench. If a vigorous swiveling motion is to be executed with such a handle, then the latter shows the tendency of assuming a flat position with one's hand, i.e. of turning into the swivel plane of the wrench, whereby the assumption and maintenance of the locked position are ensured to the highest degree.

Figure 2:
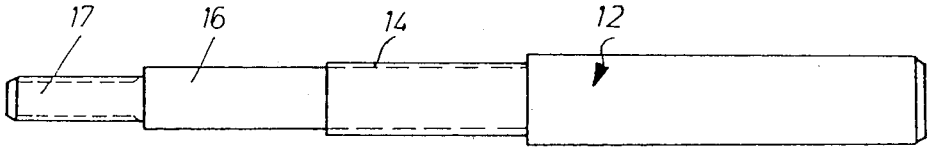
Figure 3:
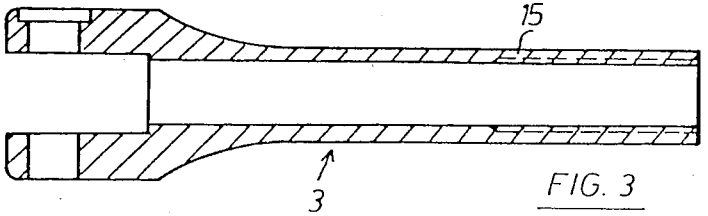
Figure 4:
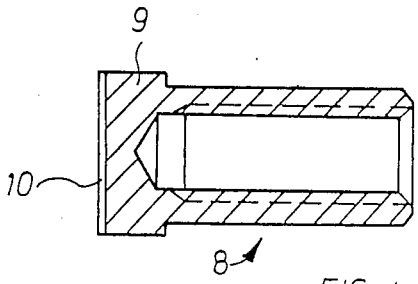
Figure 5:
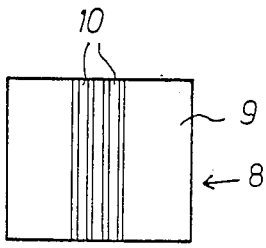
Figure 6:
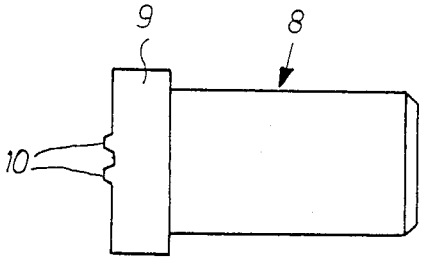
Figure 7:
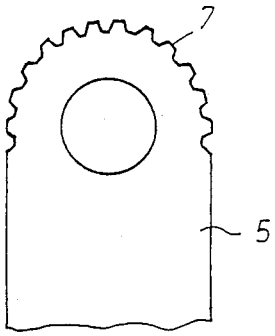
Figures 8, 9, 10, 11:
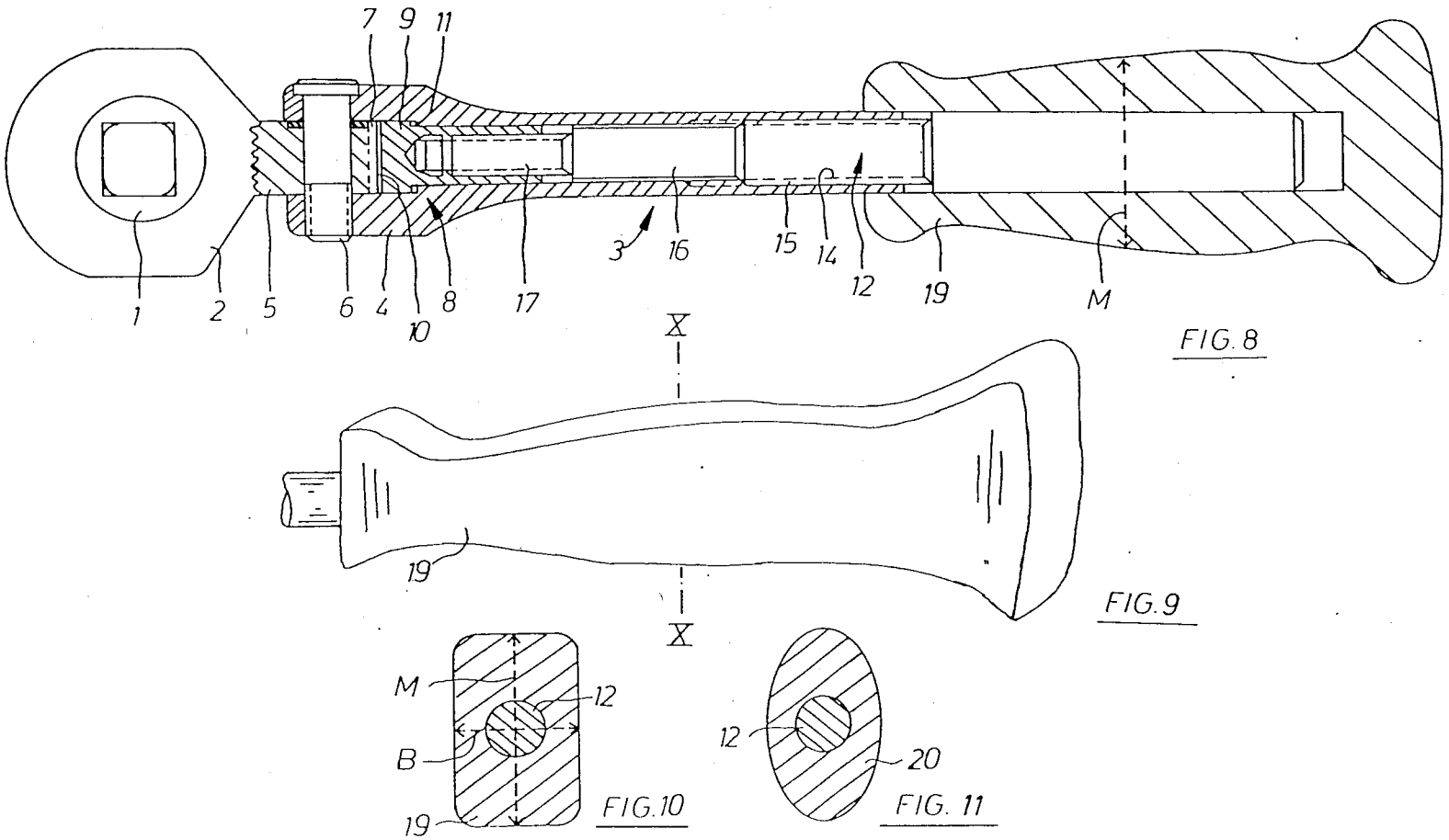

The invention will be explained in greater detail below with reference to an embodiment illustrated in the drawings wherein:

FIG. 1 is a longitudinal partial cross-sectional view of a ratchet-type wrench, largely in constructed in accordance with the present invention, FIG. 2 is a top view of the adjusting spindle of the wrench of FIG. 1, FIG. 3 is a sectional view of the lever arm for the wrench of FIG. 1, FIG. 4 is a longitudinal cross-sectional view, on an enlarged scale, of the catch member of the wrench constructed in accordance with the present invention, FIG. 5 is a plan view of the catch member as seen from the left-hand side of FIG. 4, FIG. 6 is a lateral view of the catch member of FIG. 4, FIG. 7 is a top view of a rear end of a working head of the wrench of the present invention, FIG. 8 is a longitudinal section of another embodiment of a ratchet-type wrench modified with respect to the configuration of the handle, FIG. 9 is a perspective view of the handle for the wrench according to FIG. 8, FIG. 10 shows a cross sectional view taken along the line X—X in FIG. 9, and FIG. 11 shows a modified cross-sectional shape of the handle for a ratchet-type wrench constructed in accordance with the present invention.

Referring now to the drawings wherein like reference numerals are used throughout the various views to designate like parts and, more particularly, to FIG. 1, according to this Figure, a ratchet-type wrench includes a working head 2 provided with a ratchet 1 and a lever arm 3, of tubular shape in its entirety, with the lever arm 3 being fashioned, at the front thereof, as an articulated fork 4 and encompassing, between two planar surfaces thereof, the rearward, flat portion 5 of the working head 2. The lever arm 3 can be swiveled with respect to the working head 2 about a hinge pin 6. The rearward flat portion 5 of the working head 2 carries a serration 7 on its rear lying in the articulated fork 4, with the individual teeth of the serration 7 extending in parallel to the axis of the hinge pin 6. A catch member generally designated by the reference numeral 8 is supported within the tubular lever arm 3 so that it is axially displaceable but is fixed against rotation due to its forward square head 9. At its forward square head 9, the catch member is provided with two parallel, wedge-shaped ridges 10 adapted to the dimensions of the serration 7 and insertable in a shape-mating fashion in two tooth grooves. Toward the rear, the axial displaceability of the catch member 8 is limited by an internal shoulder 11 arranged at the lever arm 3, with the square head 9 coming into contact with this shoulder 11.

A spindle generally designated by the reference numeral 12, having a staggered diameter, serves for adjusting the catch member 8; with a handle 13 being rigidly attached on the thickest section thereof and extending with a forward, bead-like end portion 13*a* over the rear end of the lever arm 3. A threaded section 14 adjoins with the threaded portion, this section 14 being threaded into a section of the lever arm 3 provided with internal thread 15. A forward threaded neck 17 follows a smooth reduced diameter portion 16, of the spindle 12. The threaded neck 17 is inserted in an axially threaded bore of the catch member 8. The threads 14 and 17 run counter to each other so that, when the handle 13 is turned in one direction, the spindle 12 is moved toward the left and additionally the catch member 8 is moved relative to the spindle 12 toward the left in the direction toward the locked position, while, when the handle 13 is rotated in the other direction, the unlocking motions are added up. When using threads having a lead of, for example, 1.25 mm and with a height of the serration 7 and/or the ridges 10 of about 1 mm, a rotation of the handle 13 by less than 180° is sufficient to lock or unlock the locking mechanism 18, which latter here consists, in total, of the serration 7, the catch member 8, the spindle 12, and the handle 13.

In FIG. 8 a ratchet-type wrench is provided having a modified handle 19 wherein the wedge-like ridges 10 engage the serration 7 so that the ratchet-type wrench is in a locked position.

As can be seen from FIGS. 9 and 10, the handle 19 has a flattened cross-sectional area having the larger central axis M and the smaller central axis B. In the locked position according to FIG. 8, the handle lies flat, i.e. with its larger central axis M, or, in the swivel plane of the wrench, in other words, within the plane of illustration of FIG. 8. In order to effect unlocking, the handle 19 is rotated by, for example, 90° thus disengaging the wedge-shaped ridges 10 from the serration 7. Thereafter, the angling of the lever arm 3 with respect to the working head 2 can be changed. With another pull at the handle 19, the latter, if this should have been forgotten—is automatically rotated back from its upright position into the swivel plane and thus the locked position is once more secured.

While FIG. 10 shows a handle cross section in the form of a rectangle with rounded corners, FIG. 11 illustrates a handle 20 having an oval cross section.

I claim:

1. A ratchet-type wrench comprising:
   - a non-rotating tubular lever arm having a bifurcated joint means at a front end thereof;
   - a working head having a substantially flat portion at a rear end thereof;
   - means for pivotally mounting said flat portion at said bifurcated joint means;
   - a catch member axially displaceably non-rotatably supported in said lever arm, said catch member being provided at a front portion thereof with at least one wedge-shaped ridge adapted to be brought into engagement with a wedge-shaped serration provided at a rear end of said flat portion of said working head;
   - a spindle axially arranged in said lever arm, said spindle having a front end portion thereof in engagement with said catch member and a rear end portion in engagement with said lever arm by counter running threads;
   - a handle rotatably mounted at a rear end of said lever arm and attached to said spindle for common rotation therewith;
   - central axes of a cross-sectional area of the handle have differning lengths, with the cross-sectional area of the handle being a rectangle which is rounded or beveled at the corners, and wherein a longer cross-sectional central axis of the handle, when the working head is locked, lies within the pivot plane and in an unlocked position is at an angle with respect to the pivot plane of the wrench, with said angle being a right angle.

2. Wrenching according to claim 1, wherein a height of the serration is approximately equal to or smaller than an axial displacement path of the catch member at a 180° rotation of the spindle.

3. Wrench according to one of claims 1 or 2, wherein the handle has a bead-like end section extending over the end of the lever arm.

* * * * *